US009082360B2

(12) United States Patent
Tanaka et al.

(10) Patent No.: US 9,082,360 B2
(45) Date of Patent: Jul. 14, 2015

(54) LIQUID CRYSTAL DISPLAY DEVICE AND METHOD OF DRIVING THE SAME

(75) Inventors: Yukio Tanaka, Ishikawa-ken (JP); Tetsuya Kawamura, Saitama-ken (JP); Kenji Nakao, Ishikawa-ken (JP); Atsushi Mizuyoshi, Ishikawa-ken (JP); Kazutaka Fukushima, Ishikawa-ken (JP); Kazuyuki Sunohara, Ishikawa-ken (JP); Hidetaka Noriyama, Saitama-ken (JP)

(73) Assignee: JAPAN DISPLAY INC., Tokyo (JP)

( * ) Notice: Subject to any disclaimer, the term of this patent is extended or adjusted under 35 U.S.C. 154(b) by 865 days.

(21) Appl. No.: 12/877,551

(22) Filed: Sep. 8, 2010

(65) Prior Publication Data

US 2011/0122114 A1 May 26, 2011

(30) Foreign Application Priority Data

Nov. 26, 2009 (JP) ..... 2009-269057

(51) Int. Cl.
*G09G 3/36* (2006.01)

(52) U.S. Cl.
CPC ..... *G09G 3/3648* (2013.01); *G09G 2320/0204* (2013.01); *G09G 2320/0257* (2013.01); *G09G 2320/0271* (2013.01)

(58) Field of Classification Search
CPC ..... G09G 3/3648; G09G 2320/0204; G09G 2320/0257; G09G 2320/0271
USPC ..... 345/90, 174, 100; 348/104; 349/141, 349/129, 178, 39, 114
See application file for complete search history.

(56) References Cited

U.S. PATENT DOCUMENTS

| | | | | |
|---|---|---|---|---|
| 8,203,520 | B2 * | 6/2012 | Shimoshikiryoh | 345/99 |
| 2005/0156864 | A1 * | 7/2005 | Fujikura | 345/100 |
| 2006/0092111 | A1 | 5/2006 | Nakao et al. | |
| 2007/0103425 | A1 | 5/2007 | Tanaka et al. | |
| 2007/0115240 | A1 | 5/2007 | Tanaka et al. | |
| 2008/0024404 | A1 | 1/2008 | Tanaka et al. | |
| 2008/0024405 | A1 | 1/2008 | Fukami et al. | |

(Continued)

FOREIGN PATENT DOCUMENTS

| | | |
|---|---|---|
| JP | 2002-14363 | 1/2002 |
| JP | 2008-216859 | 9/2008 |

OTHER PUBLICATIONS

U.S. Appl. No. 13/220,932, filed Aug. 30, 2011, Tanaka, et al.

(Continued)

*Primary Examiner* — Kumar Patel
*Assistant Examiner* — Kuo Woo
(74) *Attorney, Agent, or Firm* — Oblon, McClelland, Maier & Neustadt, L.L.P.

(57) ABSTRACT

A liquid crystal display device includes an array substrate, a counter substrate and a liquid crystal layer held between the array substrate and the counter substrate. A display portion having a plurality of pixels arranged in a matrix is formed of the substrates and the liquid crystal layer. Each of the pixels includes a pixel electrode and a counter electrode arranged opposing to the pixel electrode. A driving portion is formed on the array substrate to supply a pixel voltage to the pixel electrode. A correcting circuit is formed on the array substrate to correct the voltage supplied to the pixel electrode by adding a predetermined DC voltage to the voltage supplied to the pixel electrode corresponding to gradations to be displayed in the pixel.

14 Claims, 8 Drawing Sheets

(56) References Cited

U.S. PATENT DOCUMENTS

| | | | | |
|---|---|---|---|---|
| 2008/0074568 | A1 | 3/2008 | Tanaka et al. | |
| 2008/0278644 | A1 | 11/2008 | Fukami et al. | |
| 2008/0278647 | A1 | 11/2008 | Fukami et al. | |
| 2008/0291152 | A1 | 11/2008 | Nakao et al. | |
| 2009/0009463 | A1 | 1/2009 | Tanaka et al. | |
| 2009/0033606 | A1 | 2/2009 | Tanaka et al. | |
| 2009/0237606 | A1 | 9/2009 | Higano et al. | |
| 2010/0245697 | A1 | 9/2010 | Shiiba et al. | |
| 2010/0245747 | A1* | 9/2010 | Matsuda et al. | 349/141 |
| 2010/0289786 | A1 | 11/2010 | Tanaka et al. | |

OTHER PUBLICATIONS

Japanese Office Action issued Oct. 18, 2011, in Patent Application No. 2009-269057 (English-language translation only).

U.S. Appl. No. 13/176,027, filed Jul. 5, 2011, Sunohara, et al.

* cited by examiner

LIQUID CRYSTAL DISPLAY DEVICE AND METHOD OF DRIVING THE SAME

CROSS-REFERENCE TO RELATED APPLICATION

This application is based upon and claims the benefit of priority from prior Japanese Patent Application No. 2009-269057, filed Nov. 26, 2009, the entire contents of which are incorporated herein by reference.

FIELD

The present invention relates to a liquid crystal display device and a method of driving the same, and more particularly to a liquid crystal display device using an active matrix and a method of driving the same.

BACKGROUND

A liquid crystal display device is used for various equipments such as a television set, a car navigation equipment, a mobile terminal equipment, for example, a notebook PC and a cellular phone.

For example, in the liquid crystal display device in TN (Twisted Nematic) mode or OCB (Optically Compensated Bend) mode, a liquid crystal layer is held between a counter electrode formed on an upper side substrate and pixel electrodes formed on a lower side substrate, and the direction of alignment of the liquid crystal molecule contained in the liquid crystal layer is controlled by electrical field impressed between the counter electrode and the pixel electrodes.

Moreover, in the liquid crystal display device in IPS (In-Plane Switching) mode or FFS (Fringe-Field Switching) mode, both the counter electrode (COM electrode) and the pixel electrodes are formed on one of the substrates, and the direction of the alignment of the liquid crystal molecule contained in the liquid crystal layer is controlled by electrical field (fringe electrical field) impressed between both electrodes (for example, referring to Japanese Laid Open Patent Application No. 2002-014363). Since the liquid crystal display device in the FFS mode can secure a large aperture ratio, the liquid crystal display device achieves high brightness and excellent viewing angle characteristics.

In the liquid crystal display device in the above FFS mode, image sticking phenomenon may occur. The meaning of the image sticking phenomenon is as follows: if a gray picture (half tone picture) is displayed on a full screen after displaying a monochrome checkered pattern for a while, the pale checkered pattern remains like an incidental image.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
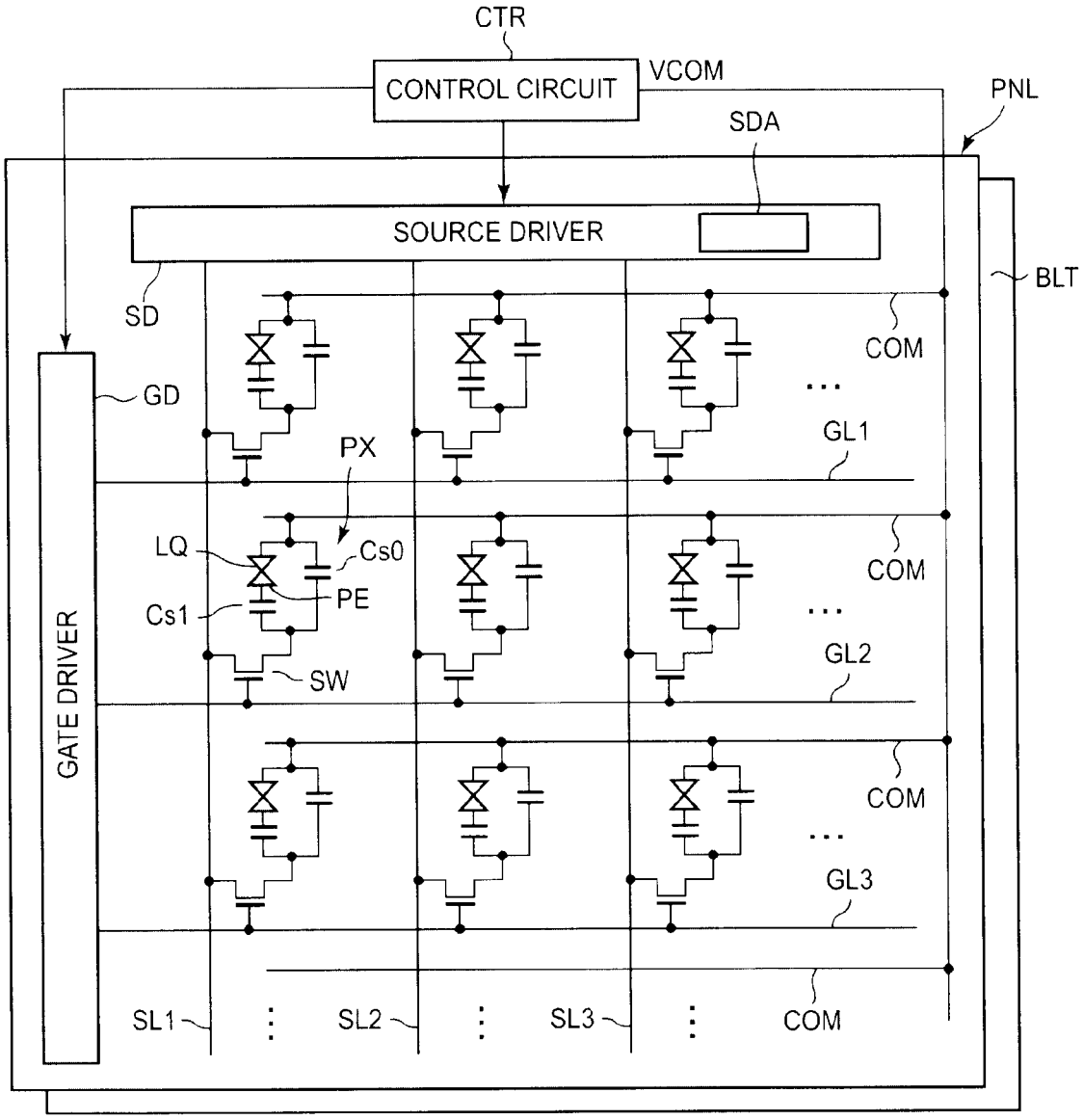
FIG. 1 is a diagram schematically showing a structure of a liquid display device according to an embodiment of the present invention.

A liquid crystal display device and a method of driving the liquid display device according to an exemplary embodiment of the present invention will now be described with reference to the accompanying drawings wherein the same or like reference numerals designate the same or corresponding parts throughout the several views.

According to one embodiment, a liquid crystal display device includes: a first substrate; a second substrate opposing to the first substrate; a liquid crystal layer held between the first substrate and the second substrate; a display portion having a plurality of pixels arranged in a matrix, each of the pixel including a pixel electrode and a counter electrode arranged opposing to the pixel electrode; a driving portion formed on the first substrate to supply a pixel voltage to the pixel electrode; a control portion to control the driving portion, and a correcting circuit to correct the voltage supplied to the pixel electrode by adding a predetermined DC voltage to the voltage supplied to the pixel electrode corresponding to gradation to be displayed in the pixel.

According to another embodiment, a method of driving a liquid crystal display device includes a first substrate, a second substrate opposing to the first substrate, a liquid crystal layer held between the first substrate and the second substrate, a display portion having a plurality of pixels arranged in a matrix, each of the pixel including a pixel electrode and a counter electrode arranged opposing to the pixel electrode, a driving portion and a control portion to control the driving portion. In case a value of a counter voltage supplied to the counter electrode is changed, the pixel voltages written into first and second pixels in which two signals respectively corresponding to first and second gradations have been written into first and second pixel electrodes accompanying with image sticking, are corrected to display a predetermined gradation by the control portion. In case the lowest average value of brightness in which a positive voltage and a negative voltage are supplied to the first pixel electrode is larger than that in which a positive voltage and a negative voltage are supplied to the second pixel electrode, the voltage supplied to the first pixel electrode is corrected so that the counter voltage deviation corresponding to the lowest value of brightness of the first pixel is approximately zero. Further, a voltage supplied to the second pixel electrode to which the signal corresponding to the second gradation has been written accompanying with image sticking is corrected so that the brightness of the second pixel becomes a predetermined value when the counter voltage deviation is zero.

Hereafter, a liquid crystal display device according to a first embodiment of the present invention is explained in detail with reference to drawings. As shown in FIG. 1, the liquid crystal display device according to the first embodiment includes a liquid crystal display panel PNL having a plurality of pixels PX arranged in a matrix, and a back light BLT as a lighting means to illuminate the liquid crystal display panel PNL from the back side of the display panel PNL.

Figure 2:
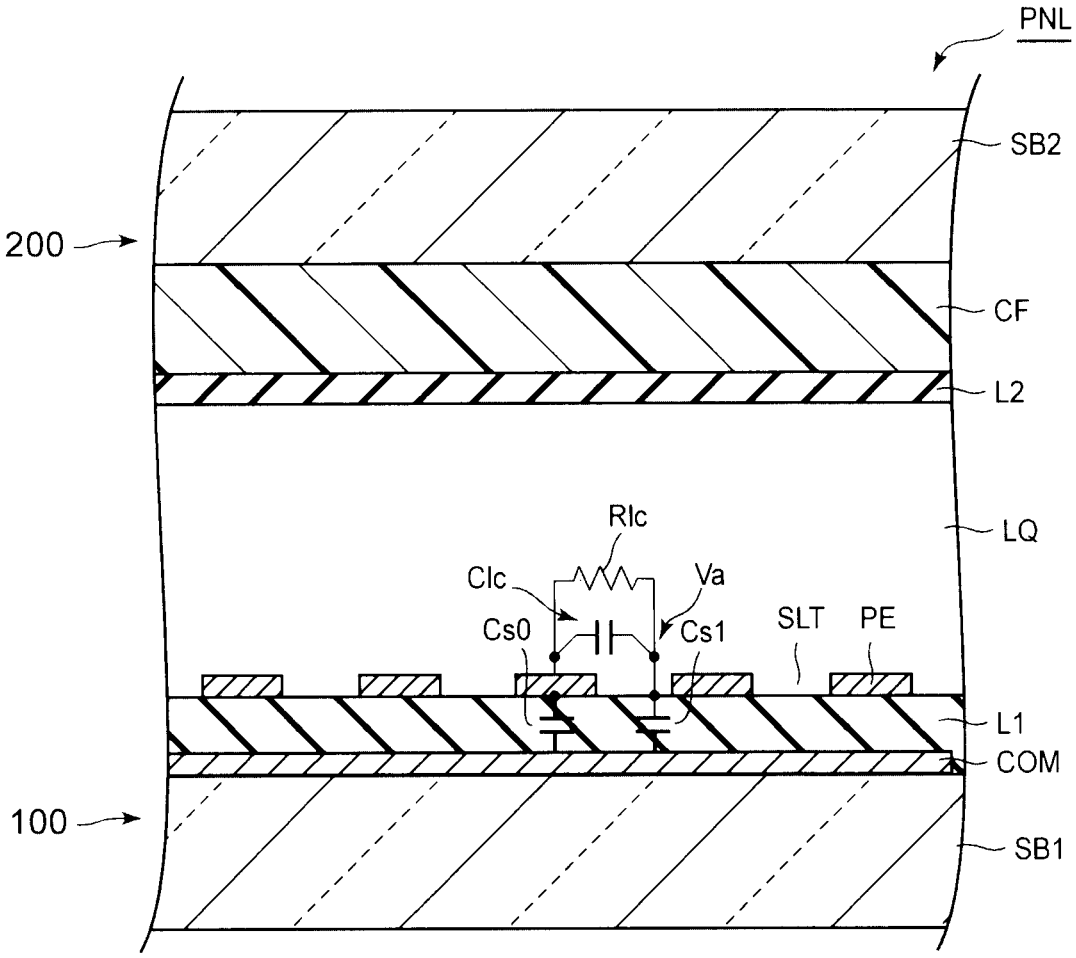
FIG. 2 is a cross-sectional view showing a structure of a display panel in the liquid crystal display device shown in FIG. 1.

As shown in FIG. 2, the liquid crystal display panel PNL includes a pair of substrates 100 and 200 and liquid crystal layer LQ held therebetween. The substrate 200 (counter substrate) includes a transparent insulating substrate SB2, color filter layer CF containing colored layers of red (R), green (G) and blue (B) arranged on the transparent insulating substrate SB2, and an overcoat layer L2 to cover the color filter layer CF. The overcoat layer L2 prevents the substance contained in the color filter layer CF from flowing into the liquid crystal layer LQ.

The array substrate 100 includes a transparent insulating substrate SB1, a counter electrode (first electrode) COM, and a plurality of pixel electrodes (second electrode) PE arranged on the counter electrode COM through an insulating layer L1, such as silicon nitride (SiN). The pixel electrode PE is arranged for the respective display pixels PX, and a plurality of holes SLT are formed in a slit shape. The counter electrode COM and the pixel electrode PE are formed of transparent conductive material, for example, ITO (Indium Tin Oxide).

The array substrate 100 includes scanning lines GL (GL1, GL2 . . . ) extending along row lines of the pixels PX, signal lines SL (SL1, SL2 . . . ) extending along column lines of the pixel PXs and pixel switches SW arranged near the positions in which the scanning lines GL and signal lines SL cross.

The pixel switch SW includes a thin film transistor (TFT: Thin Film Transistor). The gate electrode of the pixel switch SW is electrically connected with the corresponding scanning line GL. The source electrode of the pixel switch SW is electrically connected with the corresponding signal line SL. The drain electrode of the pixel switch SW is electrically connected with the corresponding pixel electrode PE.

The array substrate 100 includes a gate driver GD and a source driver SD as driving means for driving the plurality of pixels PX. The scanning lines GL are electrically connected with output terminals of the gate driver GD. Similarly, the signal lines SL are electrically connected with output terminals of the source driver SD.

The gate driver GD and the source driver SD are arranged in a peripheral region of the display panel PNL. The gate driver GD sequentially supplies ON voltage to the scanning lines GL. The ON voltage is supplied to the respective gate electrodes of the pixel switches SW electrically connected to the selected scanning line GL. A source-drain electrode path of the pixel switch PX is rendered conductive when the ON voltage is supplied to the gate electrode of the pixel PX. The source driver SD supplies respective output signals to corresponding signal lines SL. The signals supplied to the signal lines SL are supplied to the pixel electrodes PE through the pixel switches SW in which the source-drain electrode path is rendered conductive.

The gate driver GD and the source driver SD are controlled by a control circuit CTR arranged in exterior of the liquid crystal display panel PNL. The control circuit CTR supplies a common voltage Vcom to the common electrode COM.

The liquid crystal display device according to this embodiment uses the FFS (Fringe-Field Switching) mode. The direction of alignment of liquid crystal molecule in the liquid crystal layer LQ is controlled by electrical field generated by voltage difference between the counter electrode COM and the pixel electrode PE. The intensity of passing light emitted from the back light BLT is controlled by the direction of alignment of the liquid crystal molecule LQ. In addition, the operation of the back light BLT is controlled by the control circuit CTR.

Figure 3:
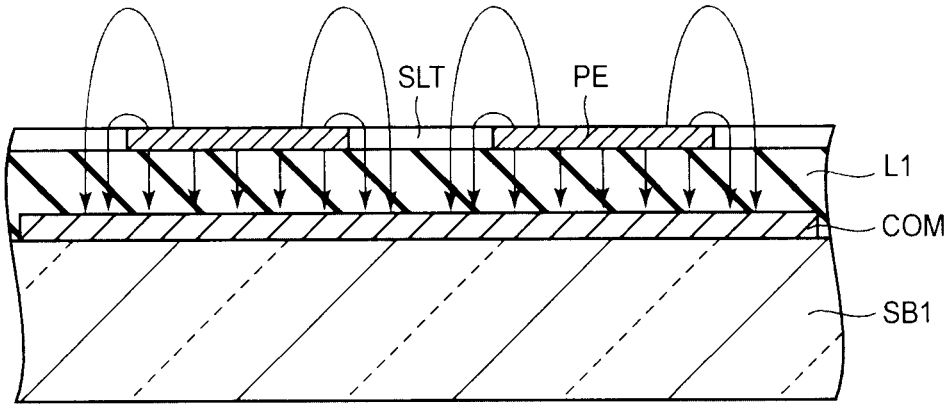
FIG. 3 is a cross-sectional view for explaining an example of electrical field generated between electrodes arranged so as to interpose an insulating layer therebetween in the liquid crystal display device in the FFS mode.

As shown in FIG. 3, if potential of a predetermined voltage difference is applied between the counter electrode COM and the pixel electrode PE, electrical field is generated not only between the common electrode COM and the pixel electrode facing each other through an insulating layer L1 but through the liquid crystal layer in the hole (slit) between the adjacent pixel electrodes PE (this is called a fringe electrical field). In the liquid crystal display device in the FFS mode, the direction of the alignment of the liquid crystal molecule is controlled by the fringe electrical field.

Capacitance ingredient Cs0 is naturally generated in a portion in which the pixel electrode PE and the counter electrode COM oppose each other interposing the insulating layer L1 therebetween as shown in FIG. 1 and FIG. 2. Auxiliary capacitance ingredient Cs1 caused by the electrical field between the pixel electrode PE and the counter electrode COM through the liquid crystal layer LQ in the hole (slit), and liquid crystal capacitance Clc exists as other capacitances than the capacitance ingredient Cs0. In addition, since it is thought that the liquid crystal layer LQ has conductivity very slightly due to residual ions etc., a leak path ingredient (resistance ingredient Rlc) in parallel with the liquid crystal capacitance Clc also exists.

In the liquid crystal display device in the above FFS mode, image sticking phenomenon may be caused. That is, if a gray picture (half torn color picture) is displayed on a full screen after displaying a monochrome checkered pattern on the screen for a while, the pale checkered pattern remains like a persistence image.

In the liquid crystal display device according to this embodiment, the source driver SD includes a correcting circuit SDA to correct output signals from the source driver SD to the signal line SL. Judgment if the signal voltage was written accompanying with image sticking to the pixel electrode PE can be made by the control circuit CTR, for example, by measuring the time while the same voltage signal has been applied to the pixel electrode PE. When a voltage signal has been applied to the pixel electrode PE beyond a predetermined period, the control circuit CTR controls the correcting circuit SDA so that a signal voltage after correction is outputted to the signal line SL as the corrected output signal.

In the liquid crystal display device according to this embodiment, the correction signal is beforehand set in a memory such as a Read Only Memory (ROM) in the correcting circuit SDA. For example, in a stage of inspection after manufacturing of the liquid crystal display device, the image sticking examination is done. That is, some brightness-VCOM characteristics curves which are explained later are measured, and the optimal correction signal is calculated based on the measurement result. The correcting circuit SDA is adjusted so that the calculated optimal correction signals are outputted. Therefore, the correcting circuit SDA is not concerned with whether the signal voltage was actually applied to the pixel electrode PE accompanying with image sticking, but the correcting circuit SDA is constituted so that the output signal to the signal line SL is corrected based on the correction signal beforehand adjusted in accordance with the gradation to be displayed on the display pixel PX.

Figure 4A:
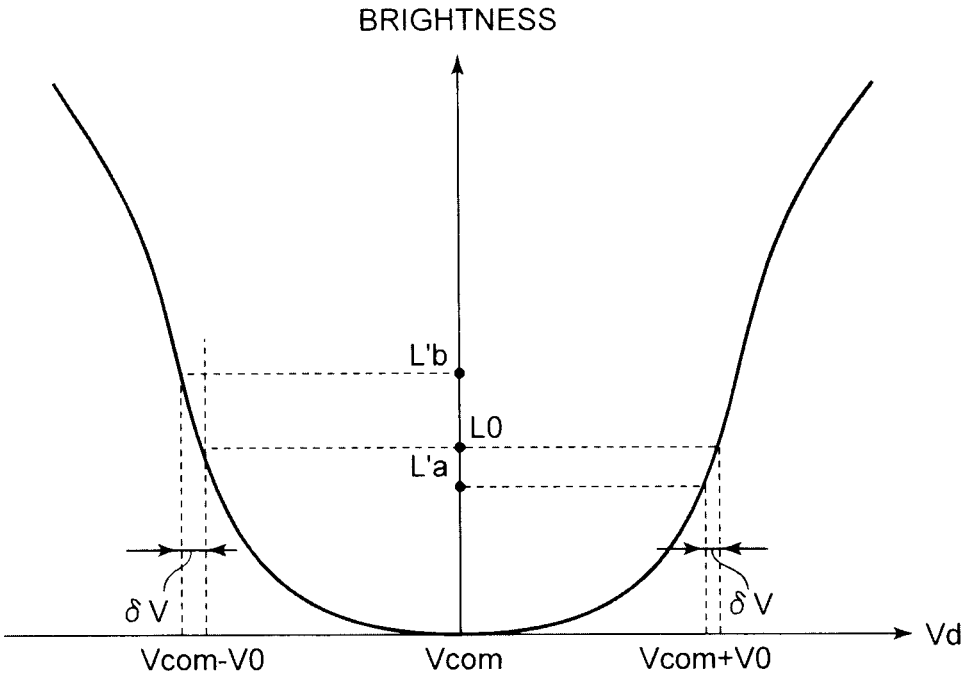
FIG. 4A is a graph for explaining an example of characteristics of brightness to the pixel electrode voltage in the liquid crystal display device in the FFS mode.

Various kinds of modes exist in the image sticking phenomenon. A brightness-VCOM characteristics curve is explained referring to FIG. 4A as a concept which is needed when considering the modes. An example of the T (brightness)–V (voltage) characteristics of the liquid crystal display device in the FFS mode shown in FIG. 2 is shown in FIG. 4A. FIG. 4A shows a graph which draws brightness with change of the pixel electrode voltage (=Vd) by setting the voltage of the counter electrode COM to a fixed voltage (=Vcom). Here, a horizontal axis shows the pixel electrode voltage Vd, and a vertical axis shows the brightness.

In a case shown in FIG. 4A, the brightness becomes higher with increase in the voltage difference (|Vd−Vcom|) between the pixel electrode PE and the counter electrode COM, and also becomes symmetrical with respect to the pixel electrode voltage Vd which becomes equal to the counter electrode COM voltage. In addition, the graph of the T-V characteristics does not necessarily become symmetrical strictly as explained later, however, here the graph is shown so that the graph is supposed to be completely symmetrical for easy understanding.

By the way, when driving the liquid crystal display device, a positive/negative polarity reversal of the signal supplied to the pixel electrode PE is made for every one-frame period in order to avoid a flicker phenomenon. In this embodiment, a rectangular wave of the counter voltage Vcom±V0 is applied to the pixel electrode PE as the pixel electrode voltage Vd, supposing the case where such the polarity-reversal drive is adopted.

According to the T-V characteristics curve shown in FIG. 4A, in a region (black write-in portion) in which the pixel electrode voltage Vd, for example, corresponding to a black display was written, if either one of Vcom±V0 is applied next, the brightness becomes the same value L0. Therefore, the positive/negative average brightness at this time becomes the brightness L0.

Furthermore, here a case is reviewed in which the rectangular wave signal voltage as the pixel electrode voltage Vd is not changed, but the counter voltage Vcom is changed. The original counter voltage Vcom should be changed to Vcom' (Vcom'>Vcom), and δV is expressed by δV=Vcom'−Vcom (hereafter, the δV is called a VCOM deviation).

In this time, an absolute value of the voltage difference between the pixel electrode voltage of positive polarity side and the counter voltage decreases by δV. On the other hand, an absolute value of the voltage difference between the pixel electrode voltage of the negative polarity side and the counter voltage increases by δV. That is, the positive/negative brightness corresponds to that in the case the pixel electrode voltages Vd of the T-V characteristics curve shown in FIG. 4A is Vcom±V0−δV, and becomes brightness La' and Lb' in the figure, respectively. Therefore, the average brightness is set to (La'+Lb')/2 when changing the counter voltage Vcom as mentioned above.

Figure 4B:
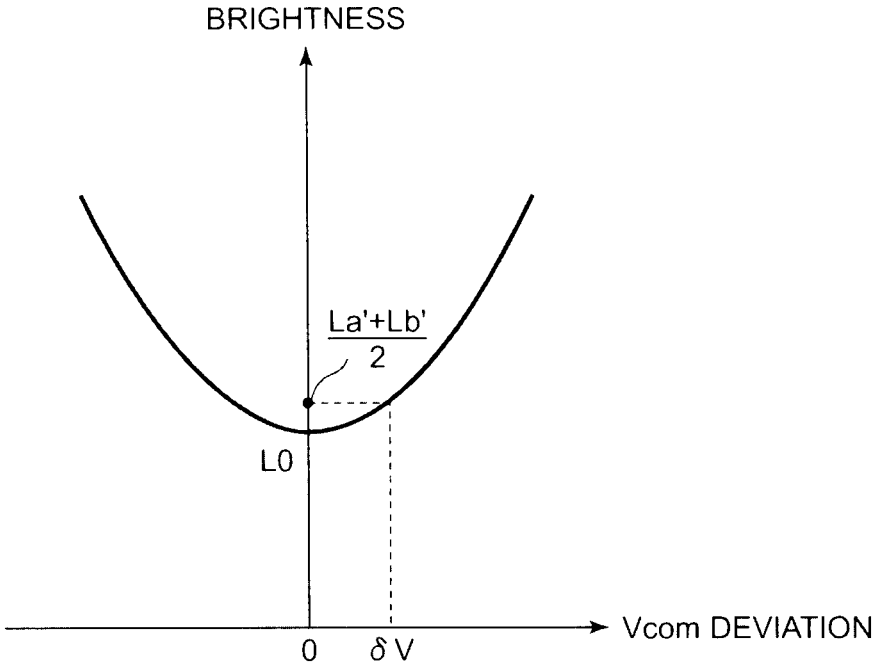
FIG. 4B is a graph for explaining an example of characteristics of the positive/negative average brightness with change of the counter electrode voltage when a rectangular wave voltage with a fixed amplitude is impressed to the pixel electrode.

Thus, FIG. 4B is a graph showing a relation between the VCOM deviation δV and the positive/negative average brightness, and the graph is called a brightness-VCOM deviation curve.

If the T-V characteristics becomes symmetrical when the pixel electrode voltage Vd and the counter voltage Vcom are equal, it is considered that the brightness-VCOM deviation curve also becomes symmetrical with respect to δV=0 (namely, Vcom'=Vcom) as shown in FIG. 4B.

Furthermore, in the T-V characteristics curve, if the pixel electrode voltage Vd is a parabolic function in a convex toward downside (a secondary differential coefficient is positive) near the counter voltage Vcom±V0, the brightness-VCOM deviation curve also becomes the convex shape toward downside. Similarly, in the T-V characteristics curve, if the pixel electrode voltage Vd is a parabolic function in a convex toward upside (a secondary differential coefficient is negative) near the counter voltage Vcom±V0, the brightness-VCOM deviation curve also becomes the convex shape toward upside.

In this embodiment, hereafter as long as there is no notice especially, the argument is made taking the case of the convex brightness-VCOM deviation curve toward downside.

As a cause of the image sticking phenomenon in the liquid crystal display device in the FFS mode, it is well known that the positive/negative average pixel voltage (DC offset) changes with the gradation displayed on the pixel PX.

For example, in the active-matrix type liquid crystal display device, ON voltage is supplied to the gate electrode of the pixel switch SW by the scanning line GL. The picture signal is written into the pixel electrode PE through the signal line SL from the source driver SD when the path between the source-drain electrodes of the pixel switch SW is rendered conductive.

In this time, if the gate electrode is selected by the scanning line GL during too short time, the writing to the pixel electrode PE becomes insufficient. That is, the predetermined output voltage (picture signal) from the source driver SD is not written in the pixel electrode PE. In such a case, it is considered that the positive/negative average of the pixel electrode voltage Vd changes depending on the gradation.

As other reason, it is considered that the pixel electrode voltage Vd fluctuates because a coupling voltage (field through voltage between the gate and the drain) is impressed through a parasitic capacitance at the moment the gate electrode voltage changes from ON voltage to OFF voltage after the selection of the gate electrode of the pixel switch SW is completed. The fluctuated portion of the pixel electrode voltage Vd causes the gradation dependency, for example, due to a dielectric anisotropy of the liquid crystal material.

Furthermore, other case is thought in which the pixel electrode voltage Vd fluctuates by leak of the thin film transistor of the pixel switch SW. The fluctuated portion of the pixel electrode voltage Vd may cause the gradation dependency.

When the average of the positive/negative pixel electrode voltage Vd is accompanied with gradation dependency by the above-mentioned various reasons, it is considered using a model how the brightness-VCOM characteristics changes at the time of the gray (half torn) display after image sticking. The path of the counter electrode COM—interface between the insulating layer L1/the liquid crystal layer—the pixel electrode PE of FIG. 2 is examined using an equivalent circuit. Here, a voltage at the interface between the insulating layer L1/the liquid crystal layer voltage is denoted as a voltage Va.

Hereinafter, as long as there is no notice especially, the review is made only paying attention to the average ingredient (DC ingredient) of the positive/negative voltage. Moreover, the average of the positive/negative pixel voltage of a gradation, for example, corresponding to a white display is voltage Vdc0, and the counter voltage is a Vcom at the time when the pixel signal was written accompanying with image sticking.

The leak which passes a resistance ingredient Rlc in the liquid crystal layer LQ is generated while the image sticking occurs. If time fully passes, the voltage Va of the interface between the insulating layer L1/the liquid crystal layer becomes equal to the voltage of the pixel electrode PE, and consequently, the voltage Va is set to a voltage Vdc0 and stabilized.

Next, the full screen is changed to the gray (half torn) display. If the positive/negative average of the pixel electrode voltage Vd in the gray gradation is set to a voltage Vdc1, the pixel electrode voltage Vd changes by (Vdc1−Vdc0). The voltage impressed to the insulating layer L1 and the liquid crystal layer LQ at this time changes by the ratio corresponding to the capacitance ratio (Cs1:Clc) of the insulating layer L1 and the liquid crystal layer LQ, and the voltage Va is shown by a following Expression (1).

[Expression 1]

$$Vdc0 + \frac{Clc}{Cs1 + Clc}(Vdc1 - Vdc0) \quad \cdots式\ (1)$$

Next, a case where the counter voltage Vcom is changed is considered to measure the brightness-VCOM characteristics. For example, if the counter voltage Vcom is changed by δV (=Vcom'−Vcom), the voltage impressed to the insulating layer L1 and the liquid crystal layer LQ also changes in accordance with the capacitance ratio (Cs1:Clc) of the insulating layer L1 and the liquid crystal layer LQ, and the voltage Va is shown by a following Expression (2).

$$Vdc0 + \frac{Clc}{Cs1 + Clc}(Vdc1 - Vdc0) + \frac{Cs1}{Cs1 + Clc}\delta V \quad \text{[Expression 2]}$$

Here, if a condition in which the voltage impressed to the liquid crystal layer LQ becomes zero is evaluated, δV=Vdc1−Vdc0 is obtained by setting the Expression (2)=Vdc1. Namely, the state where the direct-current ingredient (DC) is not impressed to the liquid crystal layer LQ is reproduced by changing the counter voltage Vcom by δV=Vdc1−Vdc0 [=(positive/negative average of the pixel voltage of the gray display after image sticking)−(positive/negative average of the pixel voltage at the time a gradation was written accompanying with image sticking)]. A brightness−VCOM characteristics curve is expressed with the parabola in which the minimum value comes to the position of the δV.

Figure 4C:
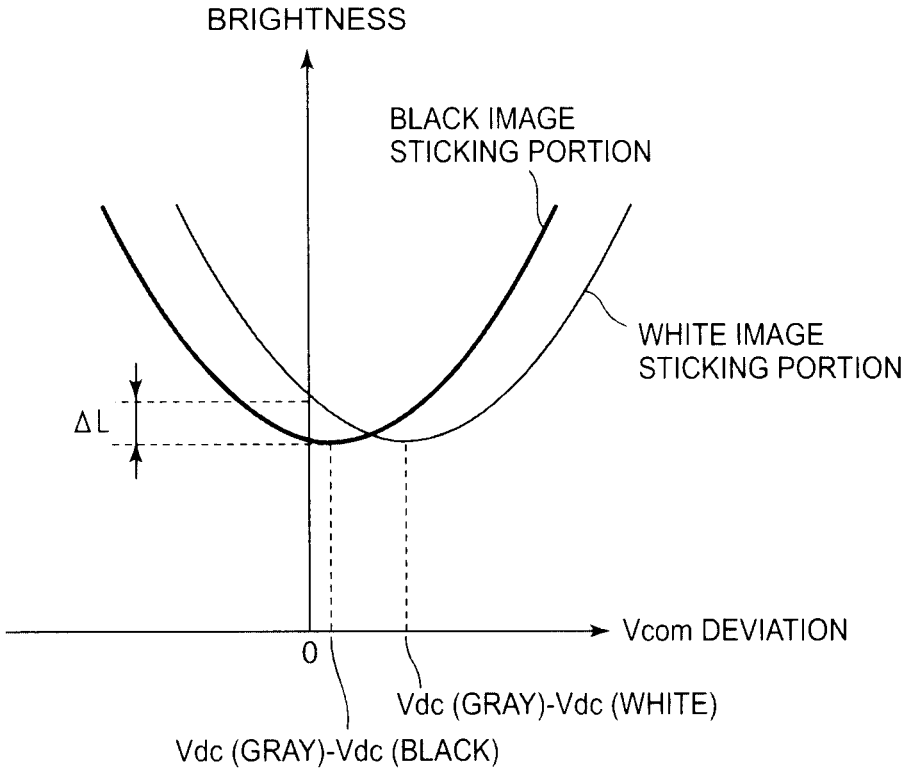
FIG. 4C is a graph for explaining another example of the characteristics of the positive/negative average brightness with change of the counter electrode voltage when a rectangular wave voltage with a fixed amplitude is impressed to the pixel electrode.

The positive/negative average of the pixel electrode voltage Vd when displaying white, black, and gray (half torn) is expressed as the voltage Vdc (white), the voltage Vdc (black), and the voltage Vdc (gray), respectively. The minimum (or maximum) position of the brightness-VCOM characteristics curve in the case where the display is changed from the white display with image sticking to the gray display, and from the black display with image sticking to the gray display, becomes the voltage (Vdc (gray)−Vdc (white)) and the voltage (Vdc (gray)−Vdc (black)) as mentioned above, respectively. Consequently, the brightness-VCOM characteristics curve is drawn as shown in FIG. 4C.

The brightness at δV=0 of the graph (hereafter called "intercept brightness") is that in the gray display after image sticking, and the difference ΔL of the intercept brightness between both graphs corresponds to the brightness difference which is sighted as the image sticking phenomenon.

As the causes for the image sticking in which the brightness-VCOM characteristics curve shifts in a horizontal axis, not only the cause originated from the DC offset impressed to the display portion from outside as mentioned above, but the cause depending on inner factors of the display portion are considered.

For example, the T-V characteristics shifts, and becomes non-symmetry with respect to the positive/negative sides by a flexoelectric effect. Moreover, when the positive/negative non-symmetry of the T-V characteristics occurs, the brightness-VCOM characteristics curve also shifts in the direction of the horizontal axis by being charged up by the color filter layer CF or the overcoat layer L2 of the counter substrate 200 side besides the flexoelectric effect. Moreover, although the case where the white image sticking portion shifts to the positive side of the horizontal axis compared with the black image sticking portion is drawn in FIG. 4B, a case where the white image sticking portion shifts to the negative side conversely is considered.

In this embodiment, when the brightness-VCOM characteristics curves drawn about two or more gradations shift in the horizontal direction (in both positive/negative polarity directions), the shift is called a DC shift mode image sticking regardless of the causes by the outside factor or the internal factor of the display panel. Accordingly, the shift of VCOM deviation δV generated by the DC shift mode, in which the brightness becomes the minimum, can be generally expressed as follows.

(δV)=(positive/negative average pixel voltage of gray display after image sticking)−(positive/negative average pixel voltage at the time a pixel voltage was written accompanying with image sticking)+(ingredient resulting from the internal factor of the display portion) Expression (3).

Here, the above ingredient resulting from the display portion generally depends on the gradation, but does not depend on the positive/negative average of the signal voltage impressed to the pixel electrode PE from the exterior.

In addition, an explanation is made about the brightness-VCOM characteristics curve after the image sticking. First, it is basically thought that the curve is hardly dependent on the preset value of the counter voltage Vcom at the time the pixel voltage was written accompanying with the image sticking. This is explained by the equivalent circuit shown in FIG. 2. Even if the counter voltage Vcom at the time the pixel voltage was written accompanying with image sticking is set as a different value, and the DC voltage ingredient is impressed between the counter voltage Vcom and the pixel electrode voltage Vd, the voltage Va and the pixel electrode voltage Vd become same potential because of the leak ingredient (resistance ingredient Rlc) in the liquid crystal layer LQ, and the DC ingredient is absorbed by the insulating layer L1 side. Accordingly, the preset value of the counter voltage Vcom does not influence to the voltage which is applied to the liquid crystal layer LQ under an equilibrium state.

Furthermore, when the brightness-VCOM characteristics curve is measured by a gray display in the full screen, the horizontal axis is not graduated by the counter voltage Vcom itself, but graduated by the deviation (δV) from the counter voltage Vcom at the time the pixel voltage was written accompanying with image sticking. Accordingly, the offset ingredient resulting from the preset counter voltage Vcom is removed, and the same brightness-VCOM characteristics curves are obtained without depending on the preset value of the counter voltage Vcom.

In the above-mentioned Expression (3), the shifting of the counter voltage Vcom is relatively equivalent to the shifting of the positive/negative average of the pixel electrode voltage to a counter direction. However, since the shifting of the counter voltage is reflected in both (positive/negative average of the pixel electrode voltage in the gray display after the image sticking) and (positive/negative average of the pixel electrode voltage at the time the pixel voltage was written accompanying with the image sticking), the shifting of the counter voltage Vcom is canceled after all. Accordingly, the VCOM deviation corresponding to the minimum brightness is thought to be constant regardless of the shifting value of the counter voltage Vcom.

Furthermore, a case where the brightness-VCOM characteristics is measured by a gray display is considered after a signal voltage corresponding to the same gray display was written into the pixel electrode PE accompanying with the image sticking. In this case, according to the Expression (3), the first and second terms of the right-hand side are cancelled each other and only the term, (ingredient resulting from the cell's internal factor) remains. That is, in only the case of the gray color image sticking, the brightness-VCOM characteristics is not influenced by the applied voltage from outside.

Next, other mode different from the DC shift mode image sticking is explained. Generally, in the FFS mode liquid crystal display device, alignment treatment (rubbing or optical alignment treatment) to the specific direction is performed in the surface of the array substrate 100 and the counter substrate 200 of the liquid crystal display panel PNL, and the liquid crystal molecule is arranged in the direction of the alignment treatment if the electrical field is not applied between the substrates 100 and 200.

When the electrical field is applied between the pixel electrode PE and the counter electrode COM, a torque in accordance with the intensity of the electrical field works in the liquid crystal molecule (not shown) contained in the liquid crystal layer LQ, and the liquid crystal molecule rotates to a place where the torque balances with a torque (alignment regulation power, or anchoring power) to return to the original alignment direction. Thus, when the liquid crystal molecule rotates, the transmissivity or brightness of the liquid crystal display device is modulated.

Figure 5A:
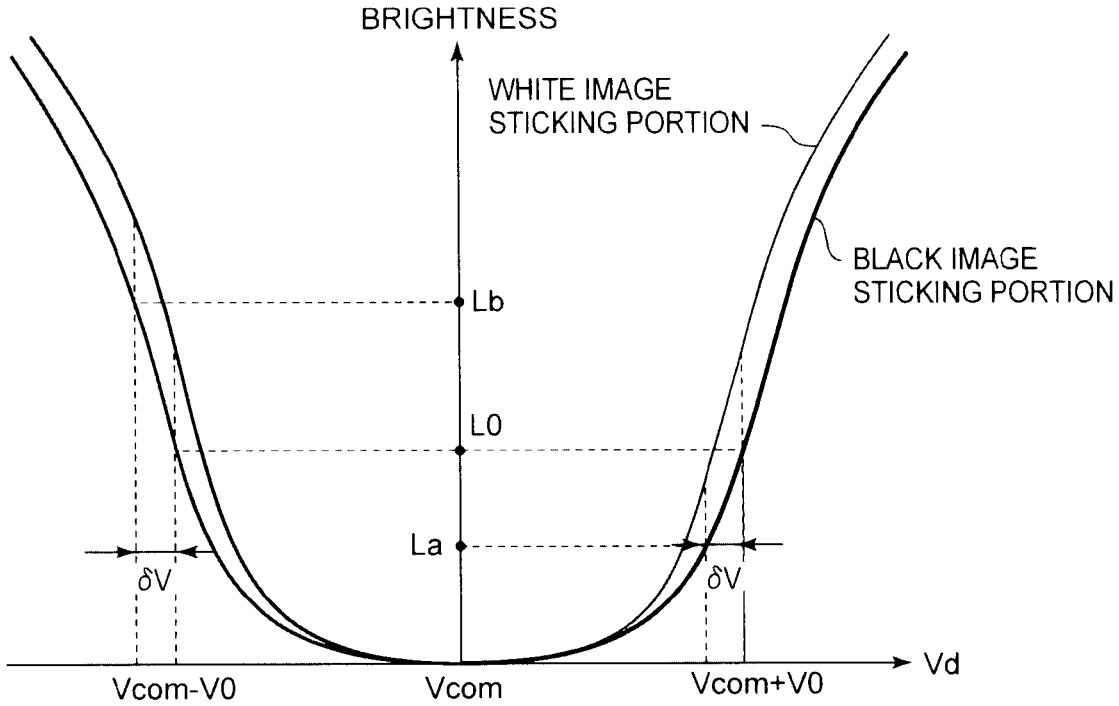
FIG. 5A is a graph for explaining other example of the characteristics of the brightness to the pixel electrode voltage in the liquid crystal display device in the FFS mode.

In the liquid crystal display device in the FFS mode according to this embodiment, when the electrical field is not applied between the pixel electrode PE and counter electrode COM, the black color is displayed, and the white color is displayed with application of the electrical field. FIG. 5A is a T-V characteristics curve showing the relation between the pixel electrode voltage Vd and the transmissivity (brightness).

In the liquid crystal display device in the FFS mode, if the angle of the alignment direction of the liquid crystal molecule stays in the state rotated from the original alignment direction i.e., a white display state for a long time, the regulation power for alignment becomes weaker by the stress, and it becomes difficult to maintain stability. In this state, the balance between the torque by the electrical field and the return torque changes, thereby a balance point shifts to the state where the liquid crystal molecule rotates more, i.e., the state near the white display (bright).

In the liquid crystal display device in the FFS mode, the above phenomenon means that the display gradation becomes bright with time, even if an equal electrical field is applied between the pixel electrode PE and the counter electrode COM. Therefore, in the T-V curve shown in FIG. 5A, the graph of the white image sticking portion is shifted above the black image sticking portion. Accordingly, in the portion in which the white display (white image sticking) continues, the gray color is more brightly displayed compared with the portion in which the black display (black image sticking) continues, even if the electrical field corresponding to the same gray display is applied.

Figure 5B:
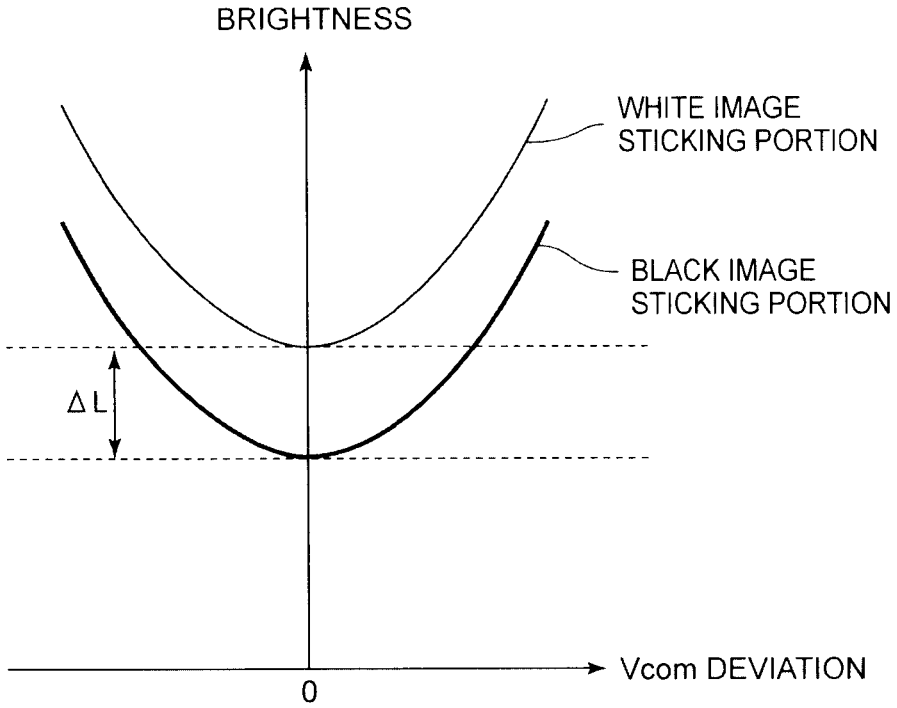
FIG. 5B is a graph for explaining other example of the characteristics of the positive/negative average brightness with change of the counter electrode voltage when a rectangular wave voltage with a fixed amplitude is impressed to the pixel electrode.

In the above case, FIG. 5B shows a brightness-VCOM characteristics curve at the time of displaying the gray display after white/black color were written accompanying with the image sticking. Since the T-V curve in FIG. 5A changes while maintains the symmetry with respect to the central axis (straight line of Vd=Vcom), the brightness-VCOM characteristics curve shown in FIG. 5B is also still symmetrical with respect to the central axis (δV=0).

However, since the brightness at the pixel electrode voltage Vd=Vcom±V0 changes on the T-V curve, the brightness-VCOM characteristics curve also becomes a curve in which its bottom level (minimum value) changes corresponding to the brightness change on the T-V curve.

The brightness (intercept brightness) in the central axis (δV=0) of the graphs is the brightness in the gray display after the image sticking, and the difference between the intercept brightness of both graphs corresponds to the image sticking. Thus, hereafter the image sticking produced by the shifting of the brightness-VCOM characteristics curve in the direction of the vertical axis is called an image sticking of the brightness bottom level fluctuation mode.

The image sticking mode in which the brightness-VCOM characteristics curve shifts in the direction of the vertical axis may be generated by the cause different from the degradation of the regulation power for alignment explained above. For example, when the color filter layer CF or the overcoat layer L2, etc. in the counter substrate 200 side is charge up, not only the DC shift mode image sticking phenomenon explained first, but the image sticking phenomenon of brightness bottom level fluctuation mode may be generated together.

In the above explanation, the sticking phenomenon of the brightness bottom level fluctuation mode is reviewed about the case (positive type) where the bottom level of the white image sticking portion is higher than that of the black image sticking portion. However, a converse case (negative type) where the white image sticking portion is lower than that of the black image sticking portion may be also possible. In this embodiment, the shifting of the brightness-VCOM characteristics curve in the direction of the vertical axis is called an image sticking phenomenon of brightness bottom level fluctuation mode, regardless of the negative or positive type and the cause of generating.

As above, two kinds of image sticking modes, the DC shift mode image sticking phenomenon and the image sticking phenomenon of brightness bottom level fluctuation mode are explained. Generally, in the actual liquid crystal display device, it is considered that both phenomena are generated simultaneously.

Figure 6A:
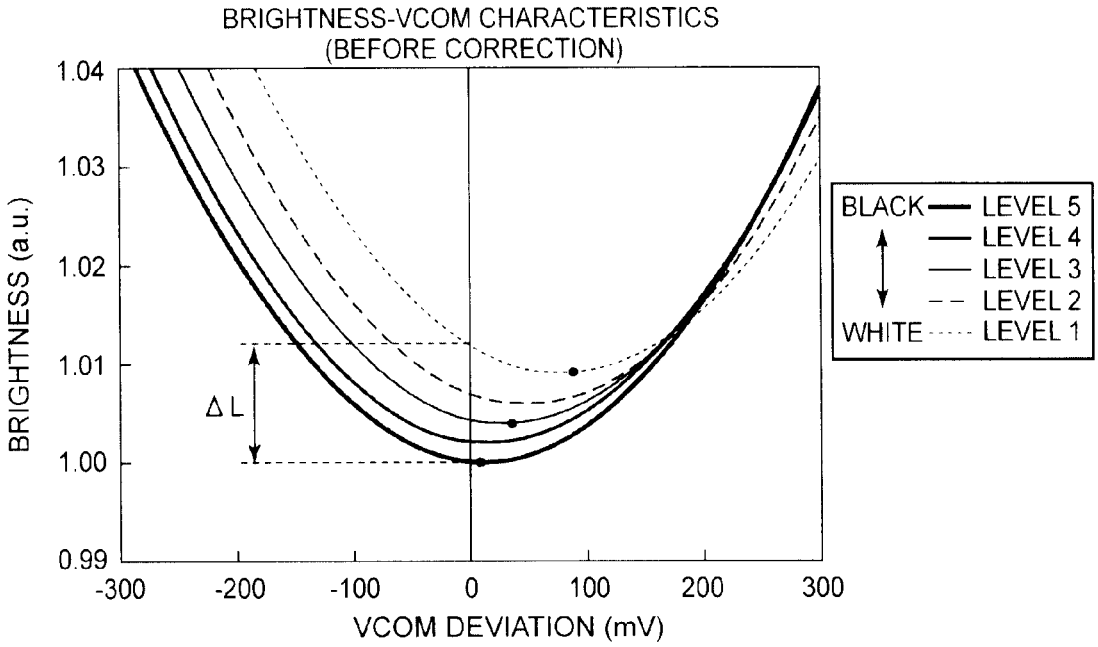
FIG. 6A is a graph showing an example of the characteristics of the positive/negative average brightness with change of the counter electrode when the rectangular wave voltage with a fixed amplitude is impressed to the pixel electrode about five gradation levels.

FIG. 6A shows an example of the brightness-VCOM characteristics curve after image sticking in the case where two kinds of above image sticking modes are generated simultaneously. In FIG. 6A, five graphs are drawn in which the electrical field applied to the liquid crystal layer at the time of image sticking is respectively changed for five gradations. Three gradations with regular intervals between a black display state (a level 5 gradation (0/63)) and a white display state (a level 1 gradation (63/63)) are made into a level 4 gradation (15/63), a level 3 gradation (31/63), and a level 2 gradation (47/63). In this embodiment, although the denominator is set to 63 ($=2^6-1$) for supposing a 6-bit display, it is not necessarily limited to the denominator.

While the bottom position (minimum position) of the brightness-VCOM characteristics curve in the gray display after the image sticking shifts to the positive direction in the horizontal-axis (δV) as shown in FIG. 6A, with the change from level 5 gradation to level 1 gradation, the bottom portion also shifts to the positive direction in the vertical-axis (brightness). Here, the vertical axis is displayed by being normalized. The brightness at the position where the vertical axis (δV=0) and each curve cross, i.e., the intercept brightness is a brightness in the gray display after the image sticking. Accordingly, larger the range of fluctuation ΔL of the intercept brightness becomes, remarkably the image sticking phenomenon appears.

Based on above review, the liquid crystal display device and the driving method of the liquid crystal display device for reducing the image sticking are explained. In addition, the gradation corresponding to the black display is shown by x=0/63 (=0), and the gradation corresponding to the white display is shown by x=63/63 (=1), using x as a parameter showing the gradation.

In the liquid crystal display device, according to this embodiment, when the value of the counter voltage Vcom supplied to the counter electrode COM is changed, the pixel voltage PE written into the pixels are corrected. An explanation is made to the case where two signals respectively corresponding to the first gradation and the second gradation have been written into first and second pixel electrodes PE accompanying with image sticking. In such a case, when pixel voltages to display new gradations are supplied to the above pixels, the amount of change of the counter voltage Vcom (VCOM deviation) corresponding to the lowest average value of the brightness in which a positive voltage and a negative voltage are supplied, is set to be equal in both the display pixels PX to which the signals corresponding to the first and second gradation displays have been written accompanying with the image sticking.

An approximate intermediate gradation level as the gray display, for example, a gradation value x=31/63 between the white gradation (level 1) and the black gradation (level 5) is adopted to observe the image sticking. However, it is not necessarily limited to the value. Here, x is expressed as follows: x=g (0<g<1). That is, when the gray level at the time of observation of the image sticking is set to the gradation value 31/63, the g is naturally expressed by g=31/63.

The source driver SD of the liquid crystal display device according to this embodiment includes a correcting circuit SDA by which the correction operation is conducted so that a DC bias depending on the gradation to be displayed on the display pixel PX is added to the output signal from the source driver SD.

Namely, in the driving method for reducing the image sticking of the liquid crystal display device according to this embodiment, a DC bias depending on the gradation to be displayed is added to the signal outputted from the source driver SD to cancel the DC shift which results in the DC shift mode image sticking phenomenon.

Figure 6B:
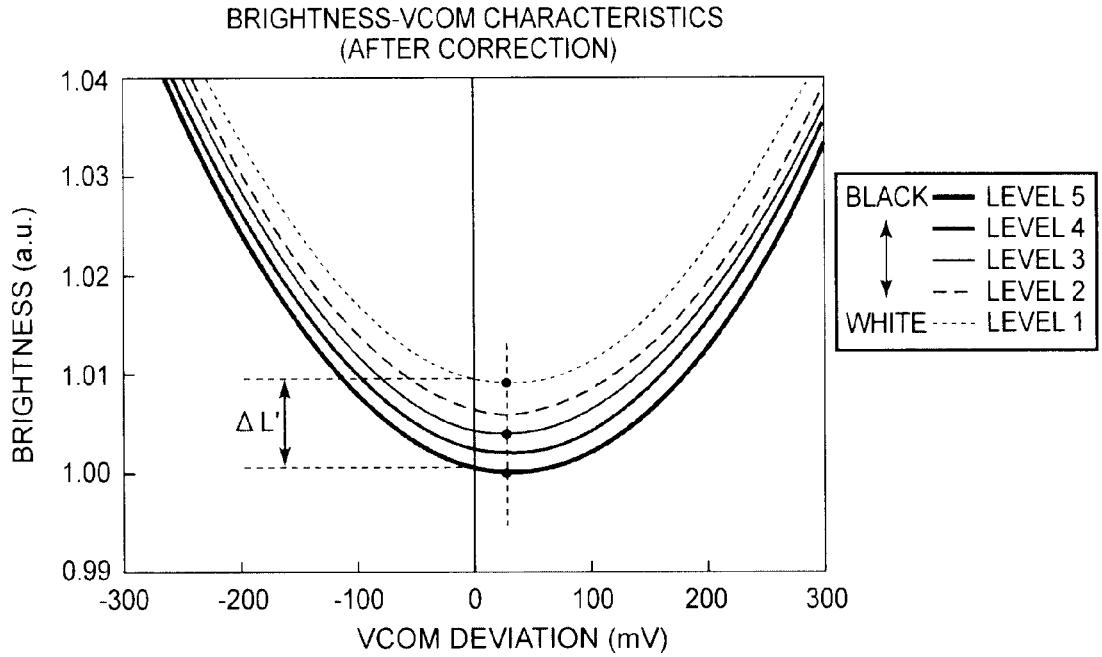
FIG. 6B is a graph for explaining an example of a method of correcting the characteristics of the positive/negative average brightness shown in FIG. 6A.

In the liquid crystal display device according to this invention, a brightness-VCOM characteristics curve is measured about the gray display (x=g=31/63) after writing gradations, x=0/63 (black), 15/63, 31/63 (gray), 47/63, and 63/63 (white) accompanying with image sticking, respectively as shown in FIG. 6B.

Here, the coordinate of the bottom of the brightness-VCOM characteristics curve for some gradations after the image sticking are shown in (δVb(x), Lb(x)). That is, the VCOM deviation in which the brightness becomes the minimum is shown by δVb(x), and the brightness at that time is shown as Lb(x).

The case is considered in which a DC bias called δVb(x)+Vc (Vc: constant value not depending on gradation) is added to the output signal of the source driver SD corresponding to the gradation x. The brightness minimum VCOM deviation at the time of using a gray display (x=g) after writing the gradation x accompanying with image sticking is thought to change by follows, using the Expression (3):

$$[\delta Vb(g)+Vc]-[\delta Vb(x)+Vc]=\delta Vb(g)-\delta Vb(x)$$

That is, when the brightness minimum VCOM deviation after correction of the output signal from the source driver SD is expressed as δVb'(x), $$\delta Vb'(x)=\delta Vb(x)+[\delta Vb(g)-\delta Vb(x)]=\delta Vb(g)$$

This means that the δVb'(x) becomes a constant value independent of the gradation x. Therefore, a brightness-VCOM characteristics curve shifts by δVb(g)−δVb(x) in the direction of the horizontal axis, and has the minimum value at the same value of the horizontal axis coordinate (=δVb (g)) as shown in FIG. 6B.

The extent of the image sticking corresponds to the range of fluctuation of the intercept brightness. By adopting this driving method, it becomes possible to make decrease the range of fluctuation from ΔL shown in FIG. 6A to the range of fluctuation ΔL' shown in FIG. 6B. In the example shown in FIG. 6, the range of fluctuation ΔL' is reduced to about 76% compared with the range of fluctuation ΔL. Thereby, it was proved that the image sticking improvement effect is achieved.

That is, in the liquid crystal display device and its driving method according to this embodiment, it becomes possible to suppress the image sticking and to supply a high quality liquid crystal display device and a method driving the same.

In addition, as apparent from the above explanation, only the DC ingredient which depends on the gradation among the DC bias voltages impressed to the signal outputted from the source driver SD acts effectively, and the constant term ingredient Vc uniformly impressed to all gradations does not influence to the result.

Next, the liquid crystal display device according to the second embodiment is explained. In the following explanation, with respect to the same composition as the liquid crystal display device according to the above-mentioned first embodiment, the same or like reference numerals are denoted and the corresponding explanation is omitted.

In the liquid crystal display device and the driving method according to the above-mentioned first embodiment, the image sticking phenomenon can be controlled as mentioned above. However, there may be some cases in which it is difficult to control the image sticking by the above-mentioned first embodiment.

According to the second embodiment, even if it is difficult to improve the liquid crystal display device and the driving method by the first embodiment, it is possible to control the image sticking.

In the liquid crystal display device according to the second embodiment, when the value of the counter voltage Vcom supplied to the counter electrode COM is changed, the pixel voltage PE written into the pixels are corrected as follows. When two signals respectively corresponding to the first gradation and the second gradation have been written into first and second pixel electrodes PE accompanying with image sticking, and pixel voltages to display new gradations are supplied to the above pixels, if the lowest average value of the brightness in which a positive voltage and a negative voltage are supplied to the first pixel electrodes PE, is larger than that in which of a positive voltage and a negative voltage are supplied to the second pixel electrodes PE, the voltage supplied to the first pixel electrode PE is corrected so that the counter voltage Vcom (VCOM deviation) corresponding to the lowest value of brightness of the first pixel PX becomes zero approximately.

Furthermore, when the amount of change of the counter voltage Vcom (VCOM deviation) is zero, the voltage supplied to the second pixel electrode PE to which the signal corresponding to the second gradation has been written accompanying with image sticking is corrected so that the brightness of the second pixel PX becomes a predetermined value.

Figure 7A:
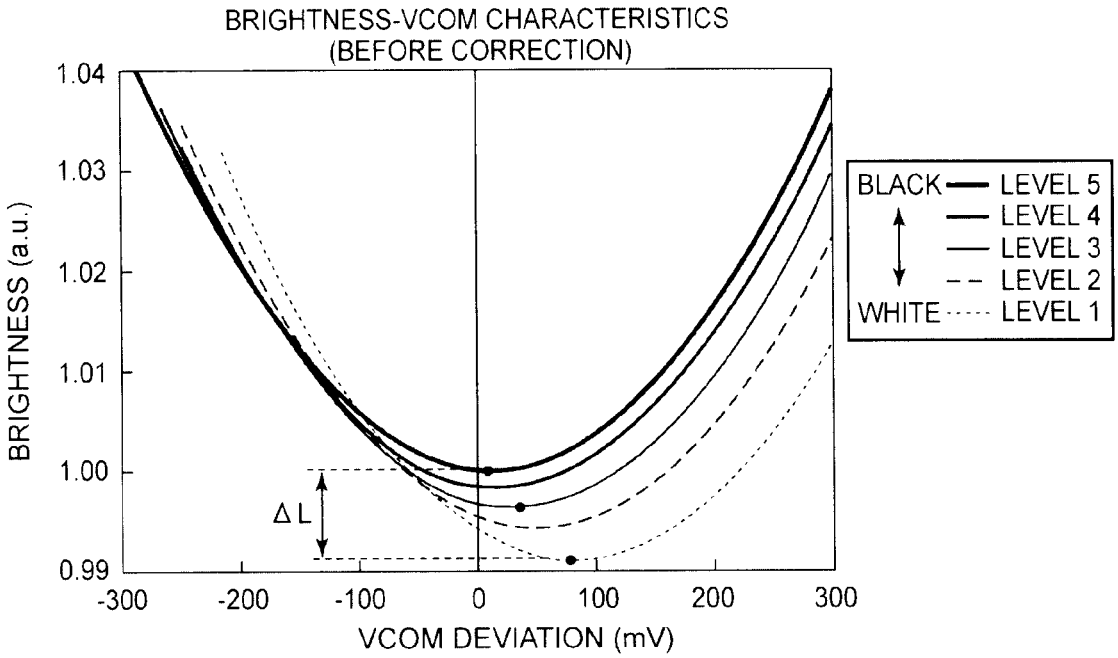
FIG. 7A is a graph showing another example of the characteristics of the positive/negative average brightness with change of the counter electrode when the rectangular wave voltage with a fixed amplitude is impressed to the pixel electrode about five gradation levels.

FIG. 7A shows an example of a brightness-VCOM characteristics curve when the gray color is displayed corresponding to the gray (x=g) gradation after the voltages corresponding to the gradation x (the level 1 (white)-the level 5 (black)) have been written with image sticking. The δVb(x) shown in FIG. 7A increases with x as well as FIG. 6A, but unlike the FIG. 6A, the brightness Lb(x) decreases with x. When a DC bias called δVb(x)+Vc (Vc: constant value not depending on gradation) is impressed to the output signal of the source driver SD like the case of the above-mentioned first embodiment, the image sticking brightness width (range of fluctuation) ΔL' after the correction of the output from the source driver SD increases rather compared with the image sticking brightness width (range of fluctuation) ΔL before the correction as shown in FIG. 7C. When the brightness after the correction is read, the range of fluctuation ΔL' becomes about 145% of the range of fluctuation ΔL, and becomes worse as the image sticking phenomenon.

In the liquid crystal display device and the method of driving the liquid crystal display device according to this embodiment, even if the case where the brightness-VCOM characteristics is shown in FIG. 7A, the image sticking is suppressed. In this embodiment, for example, when the gray color corresponding to the gradation (x=g) is displayed and the brightness-VCOM characteristics curve is measured after writing the pixel voltage corresponding to the gradation x accompanying with the image sticking beforehand, the DC bias Vdc(x) to be added to the output signal of the source driver SD corresponding to the gradation x is shown by the following expression, if the bottom coordinate is (δVb(x), brightness Lb(x)).

Namely, when the intercept brightness of the brightness-VCOM characteristics curve after the pixel voltage corresponding the gray color was written accompanying with the image sticking is shown as Lo (g), and the secondary coefficient of the brightness-VCOM characteristics curve is shown as a (>0) respectively, the Vdc(x) is expressed as follows.

(1) In case of $Lb(x)>Lo(g)$: $Vdc(x)=\delta Vb(x)+Vc$ Expression (4-1)

(2) In case of $Lb(x)\leq Lo(g)$: $Vdc(x)=\delta Vb(x)+Vc-sgn\{\delta Vb(g)\}*\sqrt{\{(Lo(g)-Lb(x))/a\}}$ Expression (4-2)

Here, the sign {y} is a signum function in which it takes 1 at the time of y≥1, and −1 at the time of y<0. Moreover, Vc is a constant value independent of the gradation. In addition, considering the meaning on the graph, Lo (g) can be expressed as Lo (g)=Lb (g)+a*{δVb(g)}$^2$.

It is considered how the brightness minimum δVb becomes at the time of correcting the output signal from the source driver SD according to the Expression (4). The DC bias amount Vdc (g) is expressed by Vdc (g)=δVb(g)+Vc−sgn {δVb(g)}*√{(Lo(g)−Lb(g))/a}=Vc by applying the Expression (4-2) since Lb(g)≤Lo (g). Here, the expression is simplified with the application of the expression: Lo(g)=Lb(g)+a*{δVb(g)}$^2$.

The bottom position after correction of the source driver output is δVb'(x)=δVb(x)+[Vdc(g)−Vdc(x)]=δVb(x)+[Vc−(δVb(x)+Vc)]=0, when the conditions of the expression (4-1) are applied.

Furthermore, the case where the conditions of the Expression (4-2) are applied, $$\begin{aligned}\delta Vb'(x) &= \delta Vb(x) + [Vdc(g) - Vdc(x)]\\ &= \delta Vb(x) + [Vc - (\delta Vb(x) + Vc - \mathrm{sgn}\{\delta Vb(g)\} * \sqrt{\{(Lo(g) - Lb(x))/a\}}]\\ &= \mathrm{sgn}\{\delta Vb(g)\} * \sqrt{\{(Lo(g) - Lb(x))/a\}}\end{aligned}$$

Furthermore, the intercept brightness Lo' (x) of the gradation x is expressed as follows:

when the conditions of the Expression (4-1) are applied, $$Lo'(x)=Lb(x)+a*\{\delta Vb'(x)\}^2=Lb(x),$$

when the conditions of the Expression (4-2) are applied, $$\begin{aligned}Lo'(x) &= Lb(x) + a*\{\delta Vb'(x)\}^2\\ &= Lb(x) + a*\left[\mathrm{sgn}\{\delta Vb(g)\} * \sqrt{\{(Lo(g) - Lb(x))/a\}}\right]^2\\ &= Lo(g).\end{aligned}$$

Namely, in the driving method by the Expression (4-1), if the bottom brightness Lbx of the brightness-VCOM characteristics curve in the gray display after the gradation x was written accompanying image sticking is larger than the intercept brightness Lo (g) in the gray display after the gray color was written accompanying image sticking, the DC bias is added to the output signal from the source driver SD so that the bottom of the brightness-VCOM characteristics curve comes on the vertical axis (δV=0).

In the driving method by the Expression (4-2), if the bottom brightness Lb(x) in the gray display after a gradation x color was written accompanying with image sticking is equal or smaller than the intercept brightness Lo (g) in the gray display after the gray color was written accompanying image sticking, the DC bias is added to the output signal from the source driver SD so that the intercept brightness of the brightness-VCOM characteristics curve is coincided with the intercept brightness Lo (g).

Hereinafter, the driving method of the liquid crystal display according to this embodiment is explained focusing on the intercept brightness. In order to suppress the image sticking, it is preferable to make the change width ΔL' of the intercept brightness Lo'(x) in the gray display after gradation x color was written accompanying image sticking small as much as possible. Furthermore, it is ideal to set the Lo'(x) to a constant value for all gradations ultimately.

However, after the gray gradation (0<x<1) color was written accompanying with image sticking, the intercept brightness Lo (g) does not change even if any corrections are made to the output signal from the source driver SD. On the other hand, when the bottom brightness Lb(x) of the brightness-VCOM curve is above the Lo (g), the intercept brightness cannot be lowered below the bottom brightness Lb(x) even if any corrections are made to the output signal from the source driver SD, that is, even if the brightness-VCOM curve is shifted any amounts in the direction of the horizontal axis. Accordingly, it is impossible to realize an ideal state. Therefore, this embodiment proposes the driving method in which the change width ΔL' of Lo'(x) is made small as much as possible under such restriction.

Figure 8:
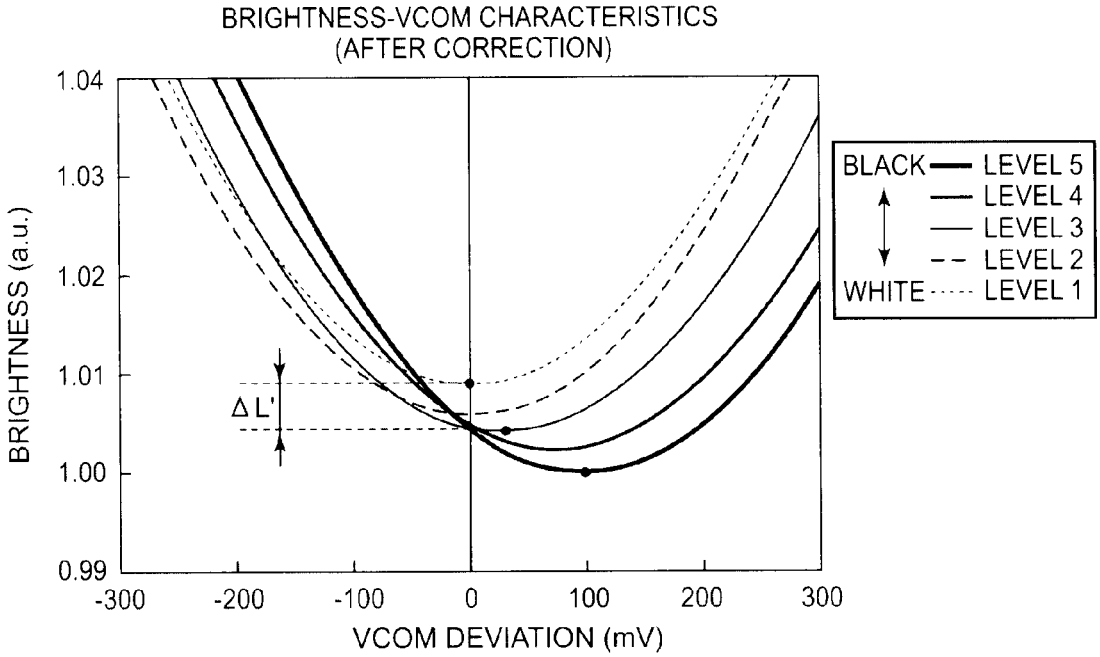
FIG. 8 is a graph for explaining other example of the method of correcting the characteristics of the positive/negative average brightness shown in FIG. 6A.

FIG. 8 shows a brightness-VCOM characteristics curve when the output signal from the source driver SD is corrected with the application of the driving method of the liquid crystal display device according to this embodiment. The brightness-VCOM characteristics curve in FIG. 8 is a result of application of this embodiment to the brightness-VCOM characteristics curve after image sticking which is completely the same as FIG. 6A.

The output signal correction of the source driver SD is performed to the state shown in FIG. 6A before the correction of the output signal from the source driver SD, using the Expressions (4-1) and (4-2). When the bottom level is below Lo (g), the intercept brightness is aligned with Lo (g), and in other cases, the output is corrected so that the bottom comes to the VCOM deviation δV=0.

According to the above correction, the range of fluctuation of the intercept brightness changes from ΔL of FIG. 6A to ΔL' of FIG. 8. The range of fluctuation ΔL' is reduced to 39% of the range of fluctuation ΔL. Therefore, the better effect is achieved than the liquid crystal display device and the driving method according to the first embodiment.

Figure 7B:
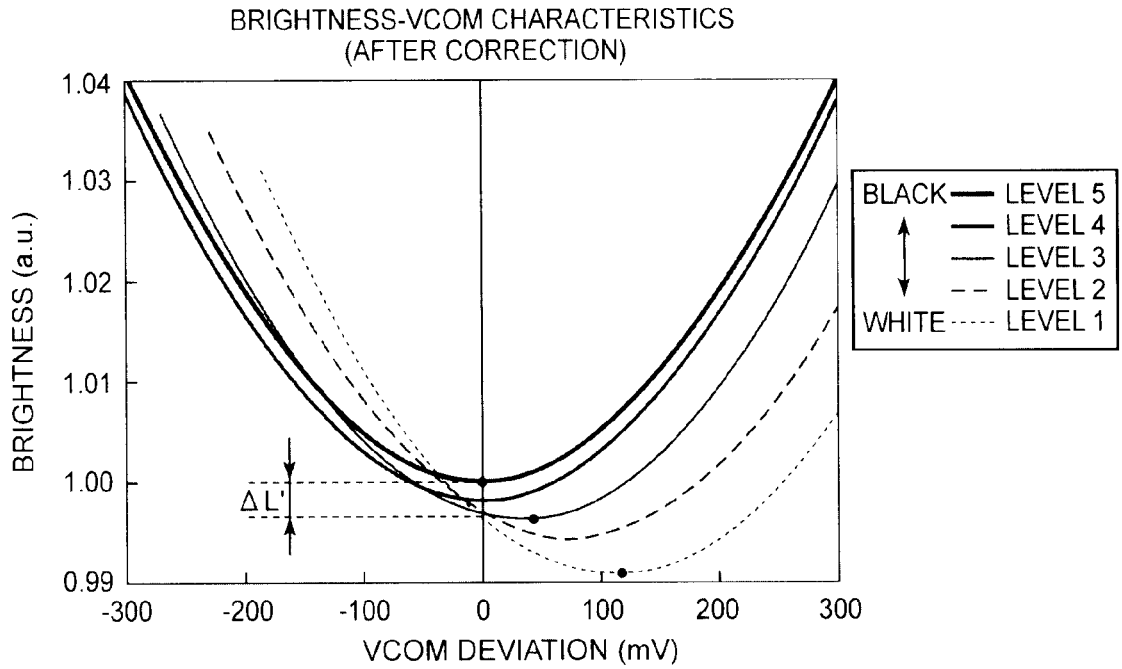
FIG. 7B is a graph for explaining an example of the method of correcting the characteristics of the positive/negative average brightness shown in FIG. 7A.
Figure 7C:
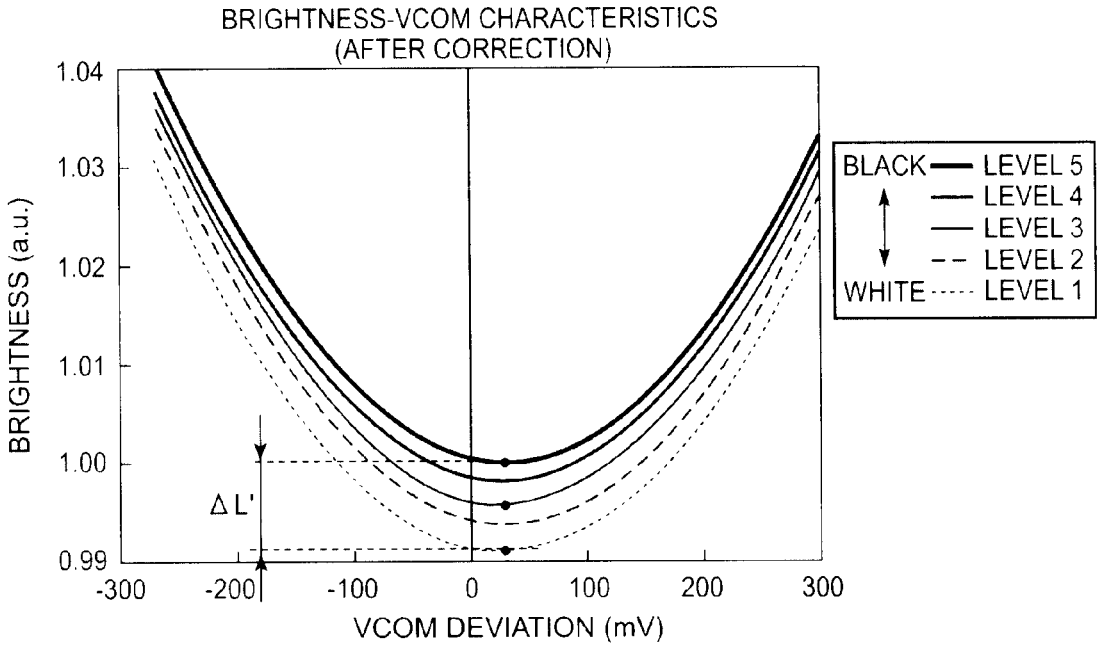
FIG. 7C is a graph for explaining another example of the method of correcting the characteristics of the positive/negative average brightness shown in FIG. 7A.

Furthermore, FIG. 7B shows an example in which the driving method of the liquid crystal display device according to this embodiment is applied to the example shown in FIG. 7A where the reduction effect of the image sticking phenomenon is not achieved according to the first embodiment.

Also, in the embodiment shown in FIG. 7B, the output signal correction of the source driver SD is performed using the Expressions (4-1) and (4-2) to the state shown in FIG. 7A before the correction. When a bottom level is below Lo (g), the intercept brightness is aligned with Lo (g), and in other cases, the output is corrected so that the bottom comes to the VCOM deviation δV=0.

According to this embodiment, the range of fluctuation of the intercept brightness changes from ΔL of FIG. 7A to ΔL' of FIG. 7B. The range of fluctuation ΔL' is reduced to 58% of the range of fluctuation ΔL, and the better effect is achieved than the liquid crystal display device and the driving method according to the first embodiment.

As mentioned above, in the liquid crystal display device and its driving method according to this embodiment, it becomes possible to suppress the image sticking and to supply a high quality liquid crystal display device and a method driving the same.

In addition, although the above-mentioned first and second embodiments explain about the case in which predetermined corrections are performed for all gradations x from "0" (black) to "1" (white), even if the corrections are not necessarily performed to all gradations, the partial effect of image sticking improvement is achieved.

It is possible to achieve partial improvement effect, even if the correction is made for only the white side (x>g) from the gray gradation (0<g<1) or only to the black side (x<g) from the gray gradation (0<g<1).

As other correction methods, a predetermined correction may be performed only about three points of x=0, g, and 1, and the Vdc(x) may be determined by a broken line approximation method for other gradations. Furthermore, as simplified method to correct, a predetermined correction may be performed only about two points, x=0 and 1, and the Vdc(x) may be determined by a straight line approximation method for the other gradations. Even if the above simplified correction methods are used, the image sticking phenomenon can be suppressed.

The gray level at the time of the observation after image sticking is set to g=31/63 (≈50%) in the above embodiment. This is because a gradation having a middle (50%) value between the white and black gradations is specified as an evaluation standard of the general image sticking in many cases.

However, when the T-V characteristics of the liquid crystal display panel or human luminous characteristics is taken into consideration, the image sticking phenomenon may become generally easy to be sighted in the gradation of the black color side. Therefore, it is possible to set the gray level at the time for observing after the image sticking to a value of darker side than the middle gradation value between the white and the black, for example, g=15/63 (≈25%).

A point to judge if an actual liquid crystal display device adopts the first and second image sticking reduction method is described. If the image sticking driving method in the liquid crystal display device according to the first embodiment is adopted, a graph with the feature as shown in FIG. 6B is obtained when a brightness-VCOM characteristics curve is measured after the actual image for each gradation level accompanying with the image sticking was written.

That is, it is the feature that a VCOM deviation in case the brightness becomes the minimum in a brightness-VCOM characteristics graph is not based on the image sticking gradation, namely, becomes a constant value. Therefore, if a DC bias depending on the gradation is added to the output voltage of the source driver, and the brightness minimum VCOM deviation after each gradation color display was written accompanying image sticking is approximately equal, it is thought that the image sticking reduction driving method of the liquid crystal display device according to the first embodiment is adopted.

Furthermore, even if the brightness minimum VCOM deviation after the image sticking for only two degradations of the black (x=0) and the white (x=1), not all degradations, is approximately equal, it is thought that the image sticking reduction driving method according to the first embodiment of the liquid crystal display device is partially adopted.

If the image sticking reduction driving method of the liquid crystal display device according to the second embodiment is adopted, a graph with the feature as shown in FIG. 7B or FIG. 8 is obtained when a brightness-VCOM characteristics curve is measured for each gradation level after imaging stick.

Namely, the feature of the curves shown in FIG. 7B or FIG. 8 is as follows. If the brightness bottom level of the curves is smaller than a specific value corresponding to Lo (g) in the figure, the respective curves pass one common point in the neighborhood of (0, Lo (g)) on a vertical axis (VCOM deviation=0 mV). Further, if the curves in which the brightness bottom level is larger than the Lo (g), the position of the brightness minimum VCOM of the respective curves is about 0 mV.

Therefore, if a DC bias voltage depending on the gradation of the output voltage of the source driver SD is impressed, and the above feature appears in the brightness-VCOM characteristics curve after each gradation was written accompanying with the image sticking, it is thought that the image sticking reduction driving method of the liquid crystal display device according to the second embodiment is adopted.

Furthermore, in the brightness-VCOM characteristics curves after image sticking for at least two gradations of the black (x=0) and the white (x=1), not for all gradations, if the brightness minimum VCOM deviation of one of the curves in which the bottom level of the curve is higher than the other is about 0 mV, and the brightness-VCOM characteristics curves of gradations close to the other gradation approximately pass a common point on a vertical axis (VCOM deviation=0 mV), it is thought that the image sticking reduction driving method of the liquid crystal display device partially uses the second embodiment.

Moreover, when the voltage of an intermediate gradation level is applied to the pixel electrode after the voltage signals corresponding to two or more gradations were written accompanying with the image sticking, if the correction is made so that the brightness becomes the smallest beyond 0 mV of the VCOM deviation in a brightness-VCOM characteristics curve in which the minimum bottom level becomes the largest among the curves, and the intercept brightness of the brightness-VCOM characteristics curves of other gradations becomes the minimum bottom level, the range of fluctuation $\Delta L$ can be approximately made into zero.

While certain embodiments have been described, these embodiments have been presented by way of example only, and are not intended to limit the scope of the inventions. In practice, the structural and method elements can be modified without departing from the spirit of the invention. Various embodiments can be made by properly combining the structural and method elements disclosed in the embodiments. For example, some structural and method elements may be omitted from all the structural and method elements disclosed in the embodiments. Furthermore, the structural and method elements in different embodiments may properly be combined. The accompanying claims and their equivalents are intended to cover such forms or modifications as would fall with the scope and spirit of the inventions.

What is claimed is:

1. A liquid crystal display device, comprising:

a first substrate;

a second substrate opposing to the first substrate;

a liquid crystal layer held between the first substrate and the second substrate;

a display portion having a plurality of pixels arranged in a matrix, each of the pixels including a pixel electrode and a counter electrode arranged opposing to the pixel electrode;

a driving portion formed on the first substrate to supply a pixel voltage corresponding to gradations to be displayed in the pixel to the pixel electrode;

a control portion to control the driving portion, and a correcting circuit to correct the voltage supplied to the pixel electrode by superimposing a predetermined DC voltage, on the pixel voltage supplied to the pixel electrode, corresponding to the gradations to be displayed in the pixel;

wherein in case a value of a counter voltage supplied to the counter electrode is changed, the pixel voltages written into the pixels in which two signals respectively corresponding to first and second gradations have been continuously applied for a predetermined time into first and second pixel electrodes are corrected, and wherein a counter voltage deviation corresponding to the lowest average value of brightness in which a positive voltage and a negative voltage are supplied to the pixels respectively to display a predetermined gradation, is set to be equal in both the pixels to which the signals corresponding to the first and second gradations have been continuously applied for a predetermined time.

2. The liquid crystal display device according to claim 1, wherein the pixel electrode is arranged on the counter electrode through an insulating layer on the first substrate.

3. The liquid crystal display device according to claim 2, wherein the display portion is operated by FFS (Fringe-Field Switching) mode.

4. The liquid crystal display device according to claim 1, wherein the first and second gradations correspond to white and black displays.

5. A liquid crystal display device comprising:

a first substrate;

a second substrate opposing to the first substrate;

a liquid crystal layer held between the first substrate and the second substrate;

a display portion having a plurality of pixels arranged in a matrix, each of the pixels including a pixel electrode and a counter electrode arranged opposing to the pixel electrode;

a driving portion formed on the first substrate to supply a pixel voltage corresponding to gradations to be displayed in the pixel to the pixel electrode;

a control portion to control the driving portion, and a correcting circuit to correct the voltage supplied to the pixel electrode by superimposing a predetermined DC voltage, on the pixel voltage supplied to the pixel electrode, corresponding to the gradations to be displayed in the pixel;

wherein in case a value of a counter voltage supplied to the counter electrode is changed, the pixel voltages written into first and second pixels in which two signals respectively corresponding to first and second gradations have been continuously applied for a predetermined time into first and second pixel electrodes are corrected, and wherein in case the lowest average value of brightness in which a positive voltage and a negative voltage are supplied to the first pixel electrode is larger than that in which a positive voltage and a negative voltage are supplied to the second pixel electrode, the voltage supplied to the first pixel electrode is corrected so that the counter voltage deviation corresponding to the lowest average value of brightness of the first pixel becomes approximately zero.

6. The liquid crystal display device according to claim 5, wherein a voltage supplied to the second pixel electrode to which the signal corresponding to the second gradation has been continuously applied for a predetermined time is corrected so that the brightness of the second pixel becomes a predetermined value when the counter voltage deviation is zero.

7. The liquid crystal display device according to claim 5, wherein the first and second gradations correspond to white and black displays.

8. A liquid crystal display device, comprising:

an array substrate;

a counter substrate opposing to the array substrate;

a liquid crystal layer held between the array substrate and the counter substrate;

a display portion having a plurality of pixels arranged in a matrix, each of the pixels including a pixel electrode and a counter electrode arranged opposing to the pixel electrode on the array substrate;

an insulating layer arranged between the pixel electrode and the counter electrode;

a plurality of signal lines and scanning lines connected to the respective pixels;

a source driver connected to the signal lines to supply image signals to the respective signal lines;

a gate driver connected to the respective scanning lines;

a control circuit to control the source driver and the gate driver; and a correcting circuit arranged in the source driver to correct a voltage corresponding to gradations to be displayed and supplied to the pixel electrode by superimposing a predetermined DC voltage, on the pixel voltage supplied to the pixel electrode, corresponding to the gradations to be displayed in the pixel; and wherein in case a value of the counter voltage supplied to the counter electrode is changed, the pixel voltages written into the pixels in which two signals respectively corresponding to first and second gradations have been continuously applied for a predetermined time into first and second pixel electrodes, and wherein a counter voltage deviation corresponding to the lowest average value of brightness in which a positive voltage and a negative voltage are supplied to the pixels respectively to display a predetermined color display, is set to be equal in both the pixels to which the signals corresponding to the first and second gradations have been continuously applied for a predetermined time.

9. The liquid crystal display device according to claim 8, wherein the display portion is operated by FFS (Fringe-Field Switching) mode.

10. The liquid crystal display device according to claim 8, wherein the first and second gradations correspond to white and black displays.

11. A liquid crystal display device, comprising:

an array substrate;

a counter substrate opposing to the array substrate;

a liquid crystal layer held between the array substrate and the counter substrate;

a display portion having a plurality of pixels arranged in a matrix, each of the pixels including a pixel electrode and a counter electrode arranged opposing to the pixel electrode on the array substrate;

an insulating layer arranged between the pixel electrode and the counter electrode;

a plurality of signal lines and scanning lines connected to the respective pixels;

a source driver connected to the signal lines to supply image signals to the respective signal lines;

a gate driver connected to the respective scanning lines;

a control circuit to control the source driver and the gate driver; and a correcting circuit arranged in the source driver to correct a voltage corresponding to gradations to be displayed and supplied to the pixel electrode by superimposing a predetermined DC voltage, on the pixel voltage supplied to the pixel electrode, corresponding to the gradations to be displayed in the pixel;

wherein in case a value of a counter voltage supplied to the counter electrode is changed, the pixel voltages written into first and second pixels in which two signals respectively corresponding to first and second gradations have been continuously applied for a predetermined time into first and second pixel electrodes are corrected, and wherein in case the lowest average value of brightness in which a positive voltage and a negative voltage are supplied to the first pixel electrode is larger than that in which a positive voltage and a negative voltage are supplied to the second pixel electrode, the voltage supplied to the first pixel electrode is corrected so that the counter voltage deviation corresponding to the lowest average value of brightness of the first pixel becomes approximately zero.

12. The liquid crystal display device according to claim 11, wherein a voltage supplied to the second pixel electrode to which the signal corresponding to the second gradation has been continuously applied for a predetermined time is corrected so that the brightness of the second pixel becomes a predetermined value when the counter voltage deviation is zero.

13. A method of driving a liquid crystal display device, including a first substrate, a second substrate opposing to the first substrate, a liquid crystal layer held between the first and second substrates, a display portion having a plurality of pixels arranged in a matrix, each of the pixels including a pixel electrode and a counter electrode arranged opposing to the pixel electrode, a driving portion and a control portion to control the driving portion;

wherein in case a value of a counter voltage supplied to the counter electrode is changed, the pixel voltages written into first and second pixels in which two signals respectively corresponding to first and second gradations have been continuously applied for a predetermined time into first and second pixel electrodes are corrected by the control portion, wherein in case the lowest average value of brightness in which a positive voltage and a negative voltage are supplied to the first pixel electrode is larger than that in which a positive voltage and a negative voltage are supplied to the second pixel electrode, the voltage supplied to the first pixel electrode is corrected so that the counter voltage deviation corresponding to the lowest average value of brightness of the first pixel becomes approximately zero, and wherein a voltage supplied to the second pixel electrode to which the signal corresponding to the second gradation has been continuously applied for a predetermined time is corrected so that the brightness of the second pixel becomes a predetermined value when the counter voltage deviation is zero.

14. The method of driving a liquid crystal display device according to claim 13, wherein the first and second gradations correspond to white and black displays.

* * * * *